US009074832B1

(12) United States Patent
Collins

(10) Patent No.: US 9,074,832 B1
(45) Date of Patent: Jul. 7, 2015

(54) SHOTGUN INSERT

(71) Applicant: Michael Collins, Blanchard, OK (US)

(72) Inventor: Michael Collins, Blanchard, OK (US)

( * ) Notice: Subject to any disclaimer, the term of this patent is extended or adjusted under 35 U.S.C. 154(b) by 0 days.

(21) Appl. No.: 14/601,843

(22) Filed: Jan. 21, 2015

(51) Int. Cl.
*F41A 21/00* (2006.01)
*F41A 21/10* (2006.01)
*F41A 35/00* (2006.01)

(52) U.S. Cl.
CPC ..... *F41A 21/10* (2013.01); *F41A 35/00* (2013.01)

(58) Field of Classification Search
CPC ..... F41A 21/10; F41A 11/02; F42B 8/10
See application file for complete search history.

(56) References Cited

U.S. PATENT DOCUMENTS

| | | | | | |
|---|---|---|---|---|---|
| 211,642 | A | | 1/1879 | Stevens | |
| 1,179,021 | A | | 4/1916 | Mayer et al. | |
| 1,191,618 | A | | 7/1916 | Saffold | |
| 2,337,021 | A | | 12/1943 | Barbieri | |
| 2,352,476 | A | * | 6/1944 | French | 102/446 |
| 2,641,860 | A | * | 6/1953 | Dial | 42/77 |
| 3,156,995 | A | | 11/1964 | Mellor et al. | |
| 3,196,569 | A | | 7/1965 | Thomason | |
| 3,339,304 | A | | 9/1967 | Knode | |
| 3,645,027 | A | * | 2/1972 | Palmer | 42/77 |
| 3,997,995 | A | * | 12/1976 | Hicks et al. | 42/77 |
| 4,126,954 | A | | 11/1978 | Plummer | |
| 4,430,940 | A | | 2/1984 | Jermunson | |
| 4,633,781 | A | | 1/1987 | Bergman | |
| 4,702,170 | A | | 10/1987 | Trudeau | |
| 5,157,210 | A | | 10/1992 | Davis | |
| 6,513,274 | B1 | * | 2/2003 | Vastag | 42/77 |
| 7,451,706 | B2 | | 11/2008 | Meyer | |
| 2008/0098922 | A1 | | 5/2008 | Gleue | |

OTHER PUBLICATIONS http://archives.woodworkslive.com/index.php?topic=2770.40.
http://www.gaugemate.com/purchase/gaugemate-gold.
http://www.gaugemate.com/hikashop-menu-for-module-64/product/1059-new-410-22ir-gaugemate-cartridge-adapter/ category_patheway-28.

* cited by examiner

*Primary Examiner* — Samir Abdosh
(74) *Attorney, Agent, or Firm* — Smith Moore Leatherwood LLP; Thomas W. Epting

(57) ABSTRACT

A device configured for insertion in the barrel of a shotgun for firing a rimfire ammunition round, and in particular, a .22 magnum rimfire round, in the shotgun. The device includes a carrier defining a bore that receives at least one rimfire ammunition round and a spring-biased extractor connected to the carrier and constructed to automatically withdraw a rimfire ammunition round from the bore upon the action of the shotgun being opened. The present invention may also include the spring-biased extractor being configured to automatically move to a retracted position relative to the carrier upon the action of the shotgun being closed and to automatically move to an extended position when the action of the shotgun is opened.

17 Claims, 8 Drawing Sheets

SHOTGUN INSERT

BACKGROUND

This invention relates generally to a shotgun insert which may be used to adapt a shotgun to fire smaller sized ammunition, including rimfire ammunition.

Shotgun ammunition typically includes centerfire rounds. Generally, most larger-gauge ammunition rounds are centerfire rounds, while most rimfire rounds are of smaller caliber. Certain applications may call for the use of shotgun ammunition having a relatively small gauge. However, many of the most popular shotguns are not designed to use small gauge ammunition.

It may be advantageous to provide a shotgun insert capable of adapting a shotgun to fire different ammunition quickly and easily, and in particular, to fire rimfire ammunition such as .22 magnum rimfire ammunition. Because the casing of a round of ammunition may expand when the round is fired, such expansion of the casing may cause it to lodge in the insert, thereby making it difficult to extract from the insert.

It may also be advantageous to provide a shotgun insert capable of removing spent rounds from the shotgun action in a quick and convenient manner.

SUMMARY

Generally, one embodiment of the present invention may include a device configured for insertion in the barrel of a shotgun for firing a rimfire ammunition round in the shotgun, the shotgun having an action that opens and closes. The device includes a carrier defining a passage, having a generally cylindrical or generally conical casing-receiving portion, that receives at least one rimfire ammunition round and a spring-biased extractor connected to the carrier and constructed to automatically withdraw a rimfire ammunition round from the passage upon the action of the shotgun being opened.

The present invention may also include the spring-biased extractor being configured to automatically move to a retracted position relative to the carrier upon the action of the shotgun being closed and to automatically move to an extended position when the action of the shotgun is opened.

The present invention also includes in one embodiment a firearm or shotgun insert comprising a carrier and a spring-biased extractor. The carrier has a first diameter and comprises a bore or passage adapted to receive ammunition having a second diameter. The first diameter is larger than the second diameter. In an embodiment of the present invention, the first diameter corresponds to a common shotgun gauge, such as 12-gauge. The first diameter can also correspond to other gauges and calibers, including but not limited to 8-gauge, 10-gauge, 16-gauge, 20-gauge, 28-gauge, and .410 caliber. The second diameter can correspond to any gauge or caliber smaller than that of the first diameter, such as .22 caliber, and in particular, .22 magnum ammunition, including multiple shot .22 magnum rounds, such as snake-shot or rat-shot cartridges, .17 caliber, 9 mm Flobert, etc. Therefore, the shotgun insert of the present invention can be used to adapt a shotgun to fire ammunition having a smaller size than the gauge of the shotgun.

Adapting a larger gauge shotgun to fire smaller ammunition can reduce the noise, recoil, and/or effective range of the shotgun discharge. A shotgun having low noise, low recoil, and/or low range can be suitable for various applications, including training applications and/or pest or snake control applications, thereby increasing the versatility of the shotgun.

Moreover, in an embodiment of the present application, the shotgun insert can be used to adapt a shotgun to fire ammunition instead of typical centerfire ammunition. The ammunition can be a rimfire round, including a rimfire round shell and, without limitation, multiple shot .22 magnum ammunition, such as snake-shot and rat-shot cartridges, etc.

In one embodiment of the present invention, the carrier and/or the bore of the carrier of the shotgun insert defines a generally cylindrical or conical casing-receiving portion. In addition, the bore of the carrier member may be off-center, so that the centerline of the bore is not coaxial with the centerline of the carrier member, thereby allowing the firing pin of the shotgun, which is configured to fire centerfire shotgun cartridge, to contact the rim of the rimfire round during the firing sequence. Alternatively, the bore and the carrier member can be coaxial in order to carry center fire rounds of smaller diameter or caliber in a barrel configured for a larger diameter or caliber round, e.g., to allow a .410 shell to be fired in a barrel configured for a 12 gauge cartridge.

In one embodiment of the present invention, the spring-biased extractor of the shotgun insert is disposed in the carrier, such as in a second bore of the carrier, where the second bore may or may not extend through the entire length of the carrier as the first bore does. The first and second bores can also be partially connected, such as at one end of the shotgun insert. Alternatively, the first and second bores can be unconnected to one another.

In one embodiment of the present invention, the spring-biased extractor can include a body member, an outwardly extending ejector member, and a spring. The body member is disposed in contact with the spring. The ejector member is coupled to the body member and extends laterally from the body member. In one embodiment of the present invention, the ejector member is adapted to engage the ammunition, such as by engaging the rim of rimmed ammunition.

In one embodiment of the present invention, the spring-biased extractor member is adapted to urge a spent ammunition round outward when the shotgun action is opened following firing or discharge. The extractor member urges the spent round outwardly from the breech of the shotgun a sufficient amount to allow the user to gain purchase or grab the spent round with his or her fingers to remove it from the carrier.

In an embodiment of the present invention, the shotgun insert further comprises a securing pin, which can comprise a screw, rod, or shaft or the like. The securing pin couples the carrier to the body portion or member of the spring-biased extractor and thereby secures the extractor in the shotgun insert. The body member of the extractor may comprise a slot or groove for receiving one end of the securing pin. The body member can also be hollow, if desired.

In another embodiment of the present invention, the securing pin may be removable and replaceable. Removing the securing pin permits one or more other components of the extractor to be removed from the carrier and/or shotgun insert. For example, the body member and/or the spring of the spring-biased extractor can be removed and/or replaced as needed. Thus, a shotgun insert according to an embodiment of the present invention permits convenient and modular repair of one or more components of the shotgun insert, such as a removable securing pin, body member, ejector member, and/or spring.

In a further embodiment of the present invention, a method of adapting a shotgun is provided, which includes providing a shotgun insert for insertion into the action of the shotgun. The method can further include inserting the shotgun insert into the shotgun action. The shotgun insert comprises a carrier and a spring-loaded extractor. The carrier member has a first diameter and comprises a bore adapted to receive ammunition having a second diameter. The first diameter is larger than the second diameter. Any shotgun insert described herein may be used.

In another embodiment of the present invention, a method of adapting a shotgun comprises adapting the shotgun to fire smaller ammunition. In another embodiment of the present invention, the method comprises adopting a shotgun to fire rimfire ammunition.

In yet another embodiment of the present invention, an adaptable shotgun kit is provided, which includes a shotgun and a shotgun insert. The shotgun insert includes a carrier having a first diameter and comprising a bore having a generally conical casing-receiving portion adapted to receive a .22 magnum round of ammunition. The generally conical casing-receiving portion has an entry portion and a neck portion substantially at the opposite end of the generally conical casing-receiving portion. The neck portion of the generally conical casing-receiving portion is a second diameter, and the entry portion of the generally conical casing-receiving portion is a third diameter. The first diameter is larger than either of the second diameter and the third diameter. In an embodiment of the present invention, the first diameter corresponds to the gauge of the shotgun barrel. The shotgun insert also includes a spring-biased extractor. Any shotgun insert described herein may be used. Further, any shotgun not inconsistent with the objectives of the present invention may be used. In one embodiment of the present invention, the shotgun comprises a 10-gauge or a 12-gauge shotgun. Such shotgun can also comprise a break-action shotgun, and the shotgun can be a single-barrel or a double-barrel shotgun, including side-by-side or over-and-under barrel configurations.

BRIEF DESCRIPTION OF THE DRAWINGS

The drawings referenced herein form a part of the specification. Features shown in the drawings are meant as illustrative of some, but not all, embodiments of the invention, unless otherwise explicitly indicated, and implications to the contrary are otherwise not to be made. Although in the drawings like reference numerals correspond to similar, though not necessarily identical, components and/or features, for the sake of brevity, reference numerals or features having a previously described function may not necessarily be described in connection with other drawings in which such components and/or features appear.

DESCRIPTION OF THE PREFERRED EMBODIMENTS

In the following detailed description of representative embodiments of the invention, reference is made to the accompanying drawings that form a part hereof, and in which are shown by way of illustration specific examples of embodiments in which the invention may be practiced. While these embodiments are described in sufficient detail to enable those skilled in the art to practice the invention, it will nevertheless be understood that no limitation of the scope of the present disclosure is thereby intended. Alterations and further modifications of the features illustrated herein, and additional applications of the principles illustrated herein, which would occur to one skilled in the relevant art and having possession of this disclosure, are to be considered within the scope of this disclosure. Specifically, other embodiments may be utilized, and logical, mechanical, material, and other changes may be made without departing from the spirit or scope of the present invention.

Accordingly, the following detailed description is not to be taken in a limiting sense, and the scope of the present invention is defined by the appended claims.

Figure 1:
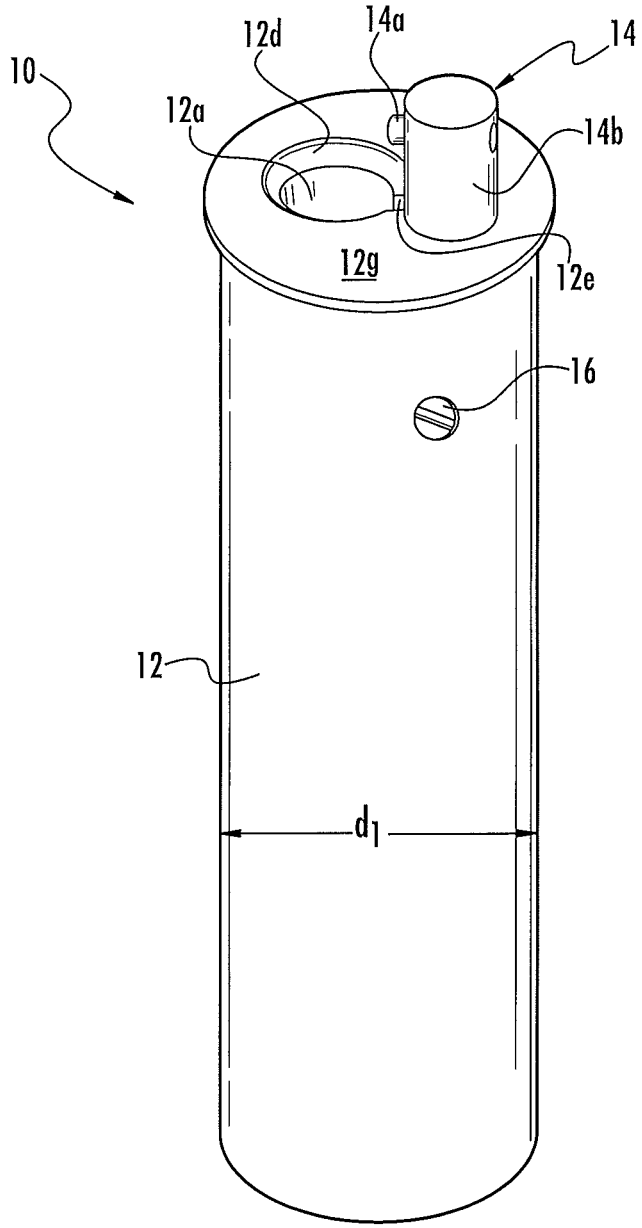
FIG. 1 is a perspective view of a shotgun insert constructed in accordance with the present invention, before insertion into the action of a shotgun and before loading of ammunition.

FIG. 1 illustrates one potential embodiment of a shotgun insert, generally 10, constructed in accordance with the present invention. It is to be understood, however, that the present invention is not limited to the specific configuration shown in the accompanying drawings, but could take on a variety of other configurations and embodiments while still incorporating the inventive aspects of the present invention.

Shotgun insert, generally 10, includes a carrier, generally 12, and a spring-biased extractor, generally 14. Shotgun insert 10 can have an overall size and shape corresponding to the overall size and shape of a standard shotgun cartridge, such as a 12-gauge shotgun cartridge or other standard shotgun cartridge. Carrier member 12 defines a passage or bore, generally 12*a*, and has a first outer diameter, generally $d_1$. Bore 12*a* defines a generally conical casing-receiving portion, generally 13. Casing-receiving portion 13 defines an entry portion

13*a* and a neck portion 13*b* generally at the opposite end of casing-receiving portion 13 from entry portion 13*a*.

Figure 2:
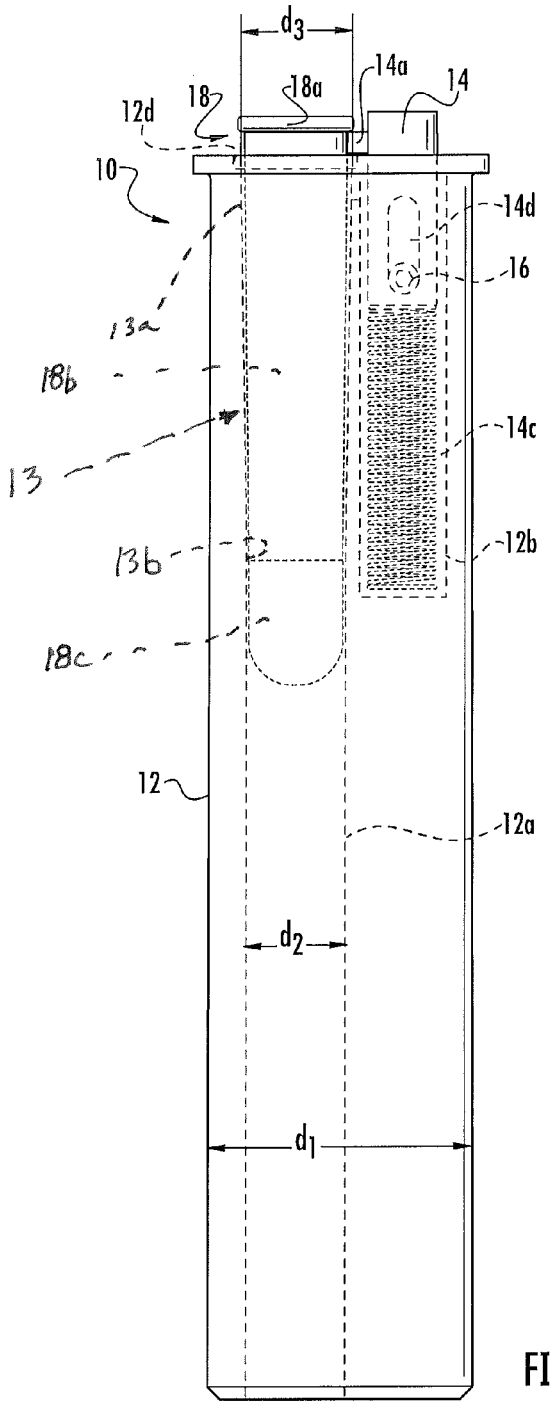
FIG. 2 is a side elevational view of the shotgun insert of FIG. 1 and illustrates internal components of the shotgun insert, after insertion of ammunition, including a bore with a generally conical casing-receiving portion having an entry portion and a neck portion of a smaller diameter than the entry portion substantially at the opposite end of the casing-receiving portion.
Figure 3:
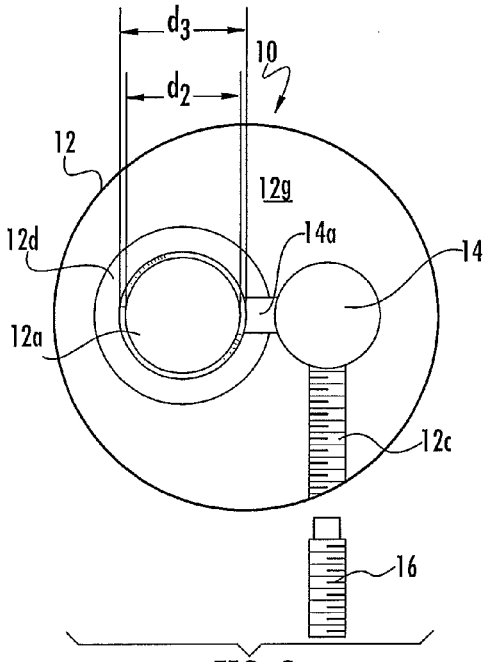
FIG. 3 is a top plan view of the shotgun insert of FIG. 1 and illustrates internal components of the shotgun insert, including a bore with a generally conical casing-receiving portion having an entry portion, and a neck portion of a smaller diameter than the entry portion.
Figure 4A:
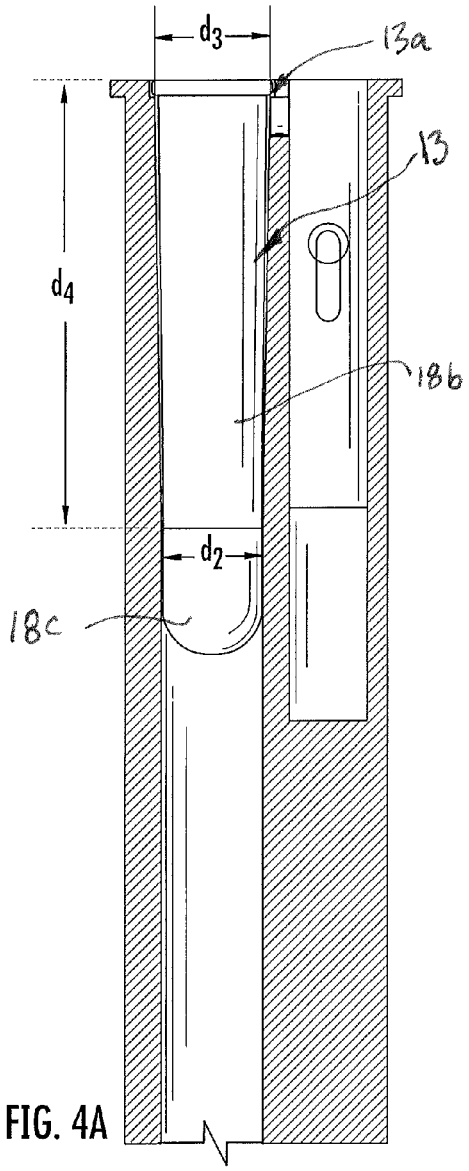
FIG. 4A is a sectional view of the shotgun insert of FIG. 1 and illustrates internal components of the shotgun insert, including a bore carrying a .22 magnum round of ammunition, the bore defining a generally conical casing-receiving portion with an entry portion and a neck portion of smaller diameter than the entry portion.
Figure 4B:
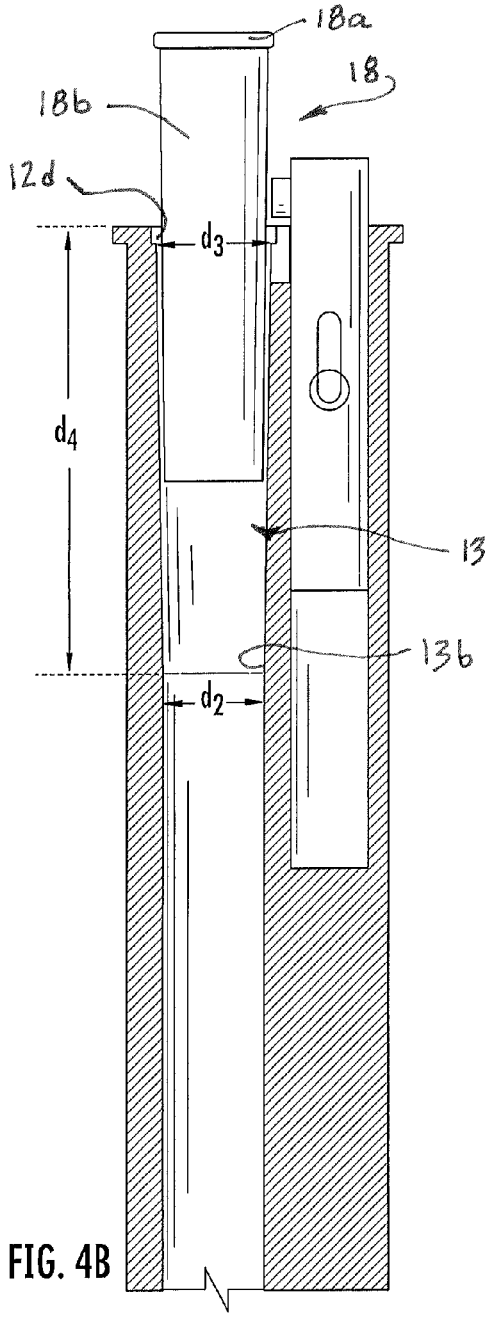
FIG. 4B is a sectional view similar to FIG. 4A of the shotgun insert of FIG. 1 and illustrates internal components of the shotgun insert, including a bore from which a spent casing of .22 magnum round of ammunition is shown in the process of being withdrawn, the bore defining a generally conical casing-receiving portion with an entry portion and a neck portion of smaller diameter than the entry portion.

As noted in FIGS. 2, 3, 4A, and 4B, neck portion 13*b* is of smaller diameter $d_2$ as compared to the diameter $d_3$ of entry portion 13*a*, which has a diameter of $d_3$. Diameter $d_2$ is slightly larger than the diameter of a round of ammunition, and in one example implementation, wherein bore 12*a* and casing-receiving portion 13 are configured for receipt of a .22 magnum round, diameter $d_2$ is slightly smaller than the approximately 0.242 inch diameter of a casing 18*b* of such a .22 magnum round. More specifically, in this example implementation, the diameter $d_2$ is approximately 0.240 inches, entry portion diameter $d_3$ is approximately 0.257 inches, and the length $d_4$ of casing-receiving portion is approximately 1.0 inches. The .22 magnum round may create enough energy when fired to force the casing 18*b*, which may be brass, into the wall of a conventional cylindrical bore, particularly if there are scratches and/or tooling marks in such bore, potentially making it difficult to remove a spent casing 18*a* therefrom. By providing casing-receiving portion 13*a* with a conical, or tapered, longitudinal cross-section (as shown in FIGS. 2, 4A, and 4B) casing 18*b* is permitted to fire form to the casing-receiving portion 13*a*, while still leaving slight clearances between casing 18*a* and casing-receiving portion 13*a*, thereby facilitating ready extraction by extractor 14. The portion of bore 12*a* extending beyond casing-receiving portion 13*a* (below casing-receiving portion 13*a* as shown in FIGS. 2, 4A, and 4B can be generally cylindrical and could be of the diameter $d_2$ if desired.

Spring-biased extractor 14 is disposed for generally rectilinear movement in a second bore or channel, generally 12*b*, defined by carrier 12 which extends substantially parallel to bore 12*a* and includes an outwardly extending ejector member, generally 14*a*, a body member, generally 14*b*, and a spring, generally 14*c*, which could be a coil spring, leaf spring, or some other suitable spring or biasing member. Extractor 14 moves within bore 12*b* between an extended position, shown in FIG. 1, and a retracted position, shown in FIG. 2. Shotgun insert 10 also includes a securing pin, generally 16.

As illustrated in FIGS. 2 and 3, securing pin 16 couples the spring-biased extractor 14 to the carrier member 12. Securing pin 16 can be threaded or unthreaded. Securing pin 16 is inserted through carrier member 12 such as through a threaded or unthreaded hole, generally 12*c*, and into a slot or groove, generally 14*d*, in body member 14*b*. Slot or groove 14*d* has a depth sufficient to permit securing pin 16 to secure spring-biased extractor member 14 in carrier body 12. Body member 14*b* can also be hollow if desired.

Slot or groove 14*d* also has a sufficient length and width to permit movement of an elongated, generally cylindrical body member 14*b* and compression and decompression of spring 14*c* as needed to permit the action, generally 20*a*, of the shotgun, generally 20, to be fully closed. Slot or groove 14*d* also has dimensions sufficient to permit spring 14*c* to urge a rimfire round, or ammunition, 18 outward when the shotgun action 20*a* is opened, including prior or after discharge of the ammunition 18. Discharging the shotgun propels from the barrel, generally 20*b*, the contents of the round, such as a bullet, shot 18*c*, multiple projectiles, etc. (not shown) while shotgun insert 10 remains in the bore 20*c* of barrel 20*b* of the shotgun. Moreover, discharging can be carried out using the standard shotgun firing pin (not shown), including a firing pin adapted for centerfire ammunition.

As shown in FIGS. 1 and 3, carrier body 12 defines a ring-shaped recess 12*d* for receiving the rimmed portion 18*a* of a rimfire round and a recess or notch 12*e* for receipt of ejector member 14*a*. Notch 12*e* extends through recess 12*d* such that when a round 18 is seated in recess 12*d*, ejector member 14*a* engages the underside of rimmed portion 18*a*, and the extreme end of round 18 is generally flush with the top surface 12*g* (FIGS. 1 and 2) of carrier body 12. This allows the action 20*a* of the shotgun to operate in normal fashion and to close prior to firing round 18 and also for the firing pin (not shown) of shotgun 20 to operate in normal fashion.

Contact between the shotgun action and the top of body member 14*b* causes compression of spring 14*c* and thus depression of the spring-biased extractor 14, such as when the shotgun action is closed, wherein extractor 14 moves from its extended position to its retracted position. Removing the contact between the shotgun action and the top of body member 14*b* such as when the shotgun action is opened, permits decompression of spring 14*c* which in turn causes elevation of the spring-biased extractor member 14 and permits extractor member 14 to automatically urge or withdraw round 18 at least partially outwardly to facilitate the user gaining purchase on round 18 to remove it from shotgun insert 10. As used herein, "withdraw" means to at least partially remove a round from bore 12*a* and can also include fully removing a round from bore 12*a*.

Spring-biased extractor member 14 is constructed to push a spent round outwardly from bore 12*a* using the engagement of ejector member 14*a* with the underside of rim, generally 18*a*, of ammunition round 18. Ejector member 14*a* can be adapted to engage ammunition rim 18*a* when ammunition 18 is loaded into bore 12*a* of carrier member 12. Engagement between ejector member 14*a* and rim 18*a* can be based on simple friction caused by the overlap and contact of ejector member 14*a* and rim 18*a*. Engagement can also be enhanced by one or more ridges, protrusions, hooks, or other means (none shown), disposed on ejector member 14*a*. Such additional features can provide increased friction or coupling between rim 18*a* and ejector member 14*a*. Moreover, ejector member 14*a* can have any size and shape not inconsistent with the objectives of the present invention. As illustrated in FIGS. 1-9, ejector member 14*a* is generally cylindrical in shape, and could be solid or hollow, as desired.

Figure 5:
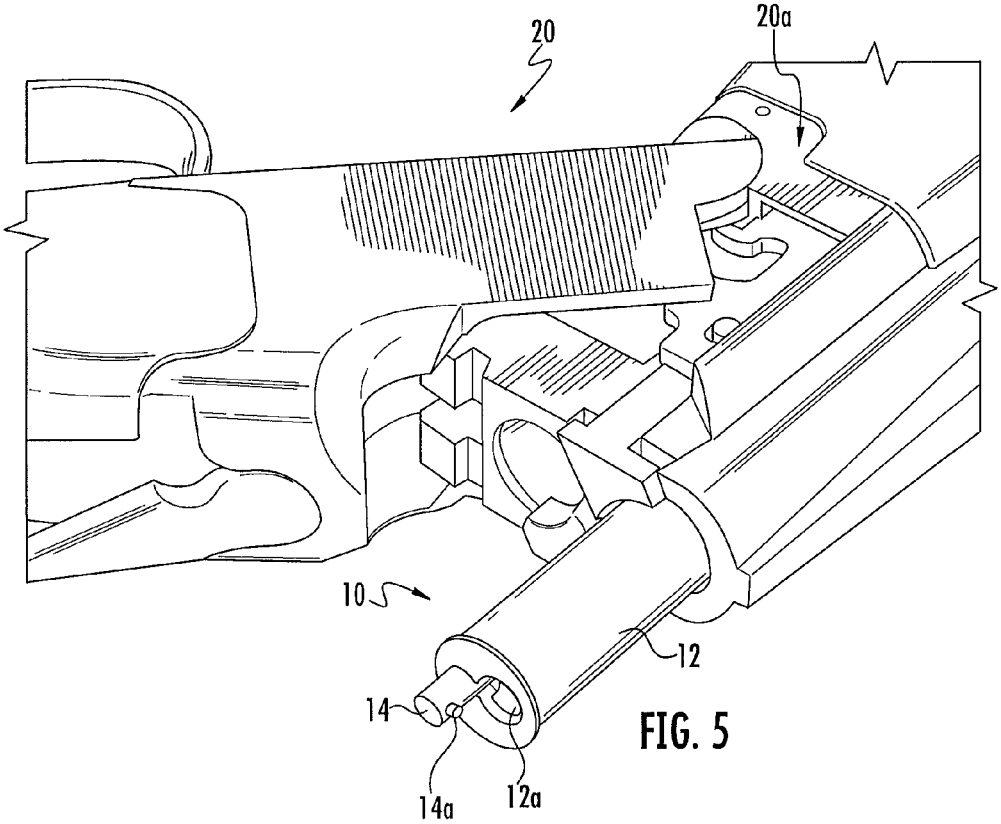
FIG. 5 is a perspective view of a shotgun insert constructed in accordance with the present invention, partially inserted into the breech, or, barrel, of a shotgun via the opened action of a shotgun.
Figure 6:
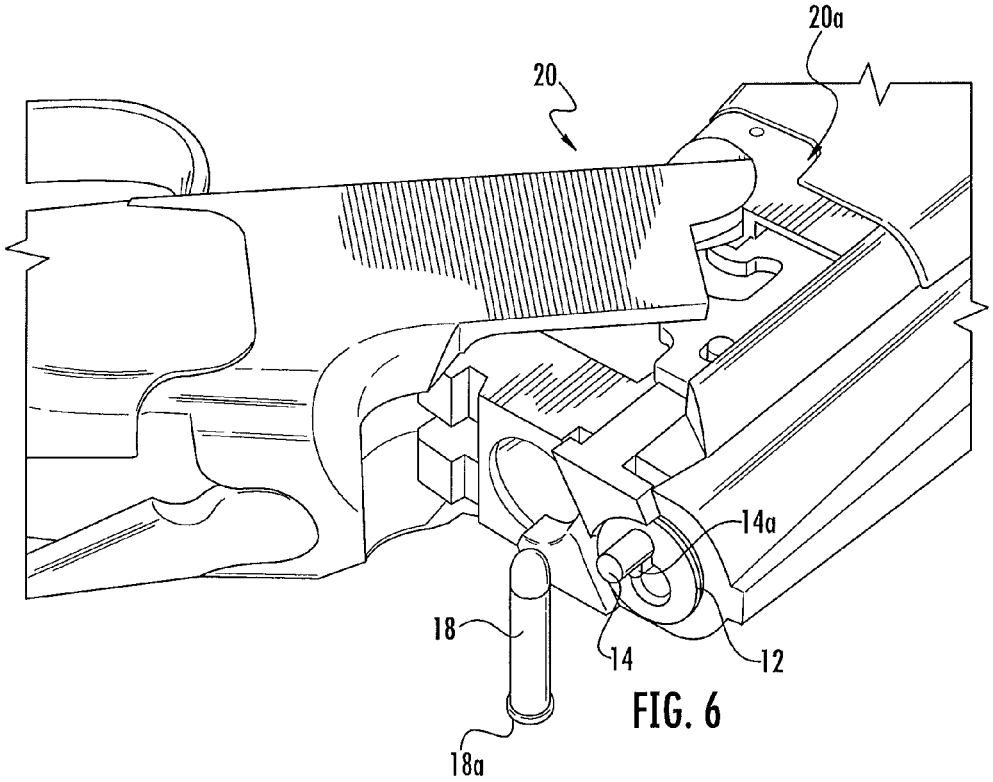
FIG. 6 is a perspective view of the shotgun insert of FIG. 5 fully inserted into the action of the shotgun and illustrates the ammunition prior to loading into the shotgun insert.
Figure 7:
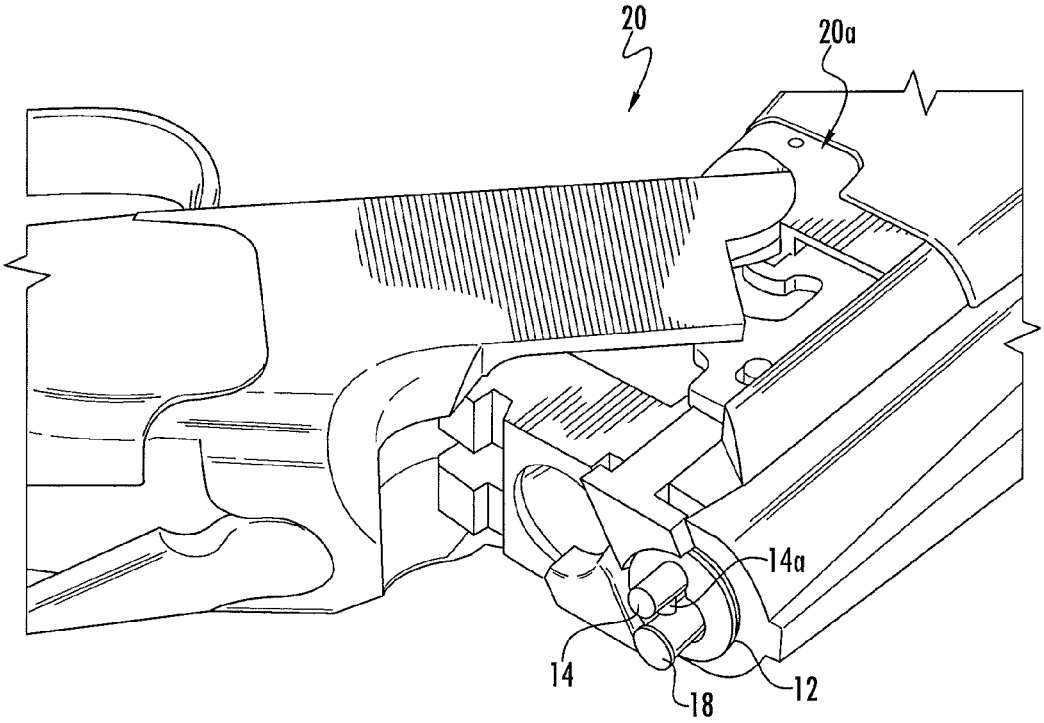
FIG. 7 is a perspective view of the shotgun insert of FIG. 6 loaded into the barrel with ammunition and an ammunition round extending into the shotgun insert.
Figure 8:
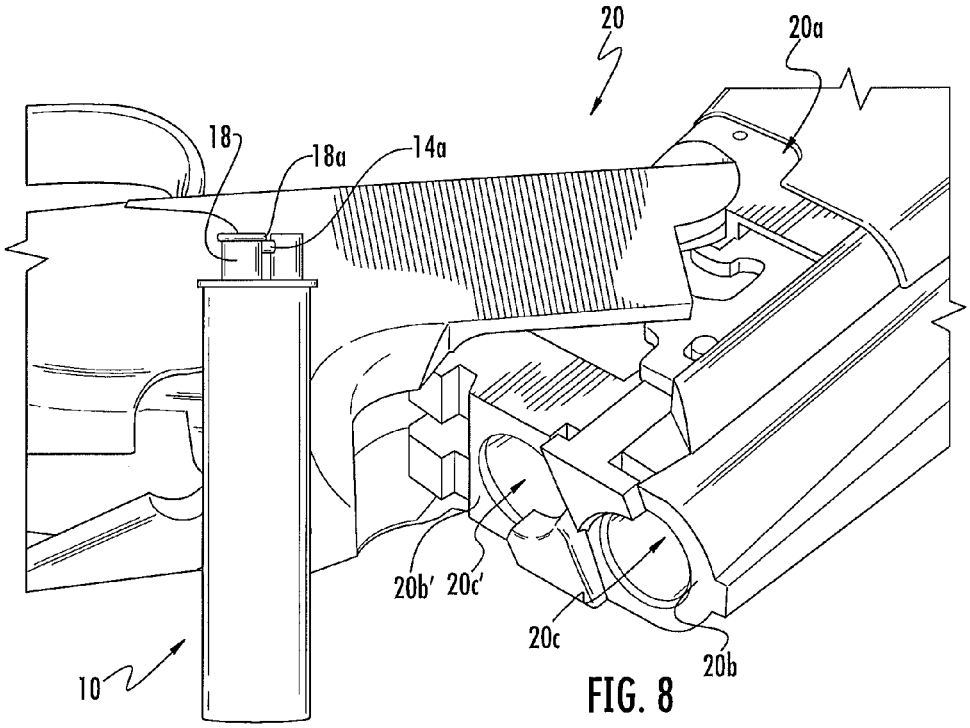
FIG. 8 is a perspective view of the shotgun insert of FIG. 7 removed from the opened action of the shotgun and illustrates the engagement of the ejector member of the spring-biased extractor with the rimmed base of the ammunition.

In FIGS. 5-8, a double barrel, over and under, shotgun is shown, having barrels 20*b*, 20*b*' and bores 20*c*, 20*c*', respectively. The ejector member extends outwardly towards bore 12*a* so that loading ammunition 18 into bore 12*a* causes initial and continued engagement between ammunition 18 and the ejector member. As illustrated in FIG. 5, shotgun insert 10 is only partially inserted into the shotgun action 20*a* of the shotgun 20. As illustrated in FIGS. 6 and 7, shotgun insert 10 is fully inserted into the shotgun action 20*a*. As illustrated in FIG. 7, ammunition 18 is partially loaded into bore 12*a*. Ammunition 18 can be further loaded into bore 12*a* to create engagement between rim 18*a* and the ejector member. Ammunition 18 can be further loaded by hand. In addition, closing shotgun action 20*a* causes depression of extractor member 14, and extractor 14 remains depressed so long as the action 20*a* is closed.

Figure 9:
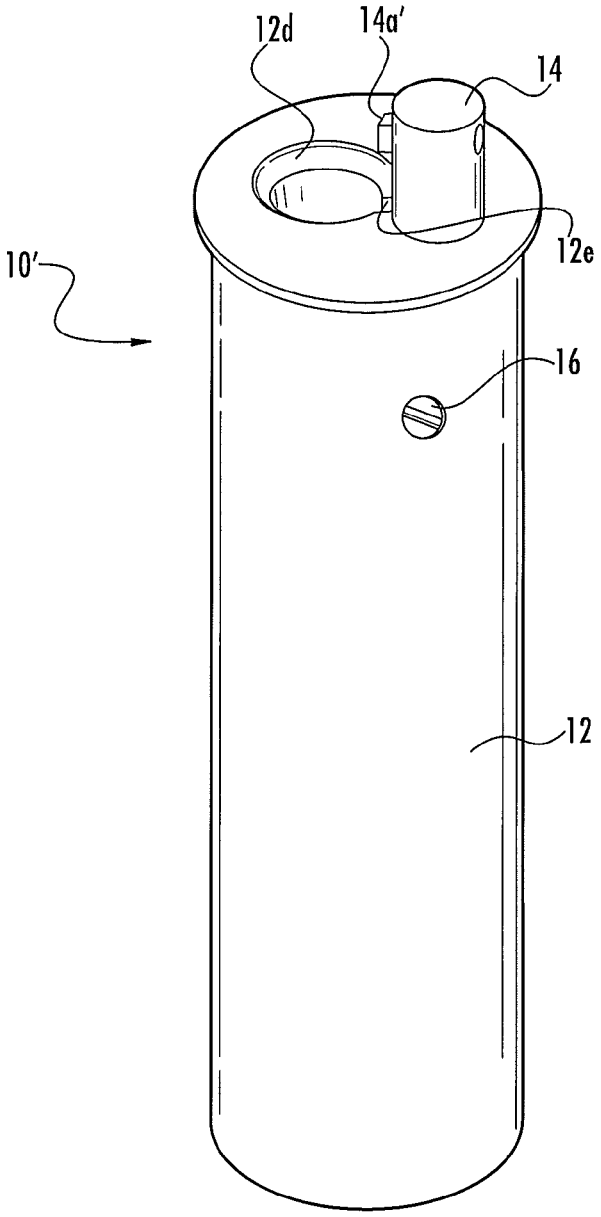
FIG. 9 is a perspective view of an alternate embodiment shotgun insert constructed in accordance with the present invention, before insertion into the action of a shotgun and before loading of ammunition.

FIG. 9 illustrates an alternate embodiment 10' of the present invention constructed similarly as the embodiment shown in FIGS. 1-7, except such alternate embodiment includes an ejector member 14*a*' (also shown in FIGS. 4-7) having a substantially box-shape with a rectangular or square cross-sectional shape.

As understood by one of ordinary skill in the art, the various components described herein can be constructed in any manner and using any materials not inconsistent with the objectives of the present invention. For example, the carrier member can be constructed of stainless steel, aluminum, firearm-grade steel, including steel alloys, brass, plastic, ceramic, or other suitable material. The metal materials can be treated in various ways, such as heat treating, annealing, quenching, and tempering.

While several embodiments have been described in detail herein, it will be apparent to those skilled in the art that the disclosed embodiments may be modified. Therefore, the foregoing description is to be considered exemplary and is not intended to limit the invention to these embodiments. On the contrary, the invention is intended to cover alternatives, modifications and equivalents, which may be included within the spirit and scope of the invention as defined by the appended claims.

Furthermore, in the detailed description of the present invention, numerous specific details are set forth in order to provide a thorough understanding of the present invention. In other instances, well-known methods, procedures, components, and configurations have not been described in detail as not to unnecessarily obscure aspects of the present invention. However, it will be recognized by one of ordinary skill in the art that the present invention may be practiced without these specific details.

What is claimed is:

1. A device configured for insertion in the barrel of a shotgun for firing a .22 magnum rimfire round of ammunition in the shotgun, the .22 magnum round having a casing, and the shotgun having an action that opens and closes, the device comprising:

a carrier defining a bore that receives the .22 magnum round of ammunition;

said bore defining a generally conical casing-receiving portion having an entry portion and a neck portion substantially at the opposite end of the casing-receiving portion;

said entry portion defining a first diameter, and said neck portion defining a second diameter, said first diameter being greater than said second diameter; and a spring-biased extractor connected to said carrier and being constructed to automatically withdraw the .22 magnum round of ammunition from said bore upon the action of the shotgun being opened.

2. The device defined by claim 1, further comprising:

said spring-biased extractor being configured to automatically move to a retracted position relative to said carrier upon the action of the shotgun being closed and to automatically move to an extended position when the action of the shotgun is opened.

3. The device defined by claim 1, further comprising:

said carrier defining a channel; and said spring-biased extractor being configured to automatically move in said channel to a retracted position relative to said carrier upon the action of the shotgun being closed and to automatically move in said channel to an extended position when the action of the shotgun is opened.

4. The device defined by claim 1, further comprising:

said spring-biased extractor including an outwardly extending portion that engages the rim of the .22 magnum round of ammunition; and said carrier defining a recess for receipt of said outwardly extending portion upon said spring-biased extractor being in said retracted position.

5. The device defined by claim 1, further comprising:

said spring-biased extractor including an outwardly extending ejector member that engages the rim of the .22 magnum round of ammunition;

said carrier defining a first recess for receipt of said outwardly extending portion upon said spring-biased extractor being in said retracted position; and said carrier defining a second recess for receipt the rim of the .22 magnum round of ammunition, said second recess being in communication with said first recess.

6. The device defined by claim 1, further comprising a securing pin connected to said extractor.

7. The device defined by claim 1, wherein said spring-biased extractor comprises a body member, an ejector member, and a spring.

8. The shotgun insert defined by claim 1, wherein said biased extractor is adapted to bias an ammunition round outward from said bore upon when the shotgun action is opened following discharge of the ammunition round.

9. The device defined by claim 1, wherein said carrier defines a central axis and said bore defines a central axis, and wherein said central axis of said carrier is not coaxial with said central axis of central axis of said bore.

10. The device defined by claim 1, further comprising:

said carrier defining a channel;

said spring-biased extractor being configured to automatically move in said channel to a retracted position relative to said carrier upon the action of the shotgun being closed and to automatically move in said channel to an extended position when the action of the shotgun is opened; and wherein said bore and said channel extend substantially parallel to one another.

11. The device defined by claim 1, wherein said first diameter of said entry portion is 0.257 inches.

12. The device defined by claim 1, wherein said second diameter of said neck portion is 0.240 inches.

13. The device defined by claim 1, wherein:

said first diameter of said entry portion is 0.257 inches; and said second diameter of said neck portion is 0.240 inches.

14. The device defined by claim 13, wherein the .22 magnum round of ammunition comprises multiple shot.

15. A method of adapting a shotgun to fire a .22 magnum rimfire round of ammunition, the .22 magnum round having a casing, and the shotgun having a barrel and an action, the method, comprising:

providing a carrier defining a bore that receives the .22 magnum round of ammunition, the bore defining a generally conical casing-receiving portion having an entry portion of a first diameter and a neck portion substantially at the opposite end of the casing-receiving portion of a diameter smaller than said first diameter;

providing a spring-biased extractor connected to said carrier constructed to automatically withdraw the .22 magnum round of ammunition from said bore upon the action of the shotgun being opened;

inserting said carrier into the barrel of the shotgun;

inserting the .22 magnum round of ammunition into said bore; and closing the action of the shotgun.

16. The method as defined in claim 15, further comprising:

opening the action of the shotgun after said carrier has been inserted into the barrel to permit said spring-biased extractor to automatically withdraw the .22 magnum round of ammunition from said bore; and removing the .22 magnum round of ammunition from said bore.

17. A kit for firing a .22 magnum round of ammunition in a shotgun, the .22 magnum rimfire round having a casing, the kit comprising:

a shotgun having a barrel and an action that opens;

a carrier defining a bore that receives the .22 magnum round of ammunition;

said bore defining a generally conical casing-receiving portion having an entry portion of a first diameter and a neck portion substantially at the opposite end of the casing-receiving portion of a diameter smaller than said first diameter; and a spring-biased extractor connected to said carrier and being constructed to automatically withdraw the .22 magnum round of ammunition from said bore upon the action of the shotgun being opened.

* * * * *